US007307203B2

(12) United States Patent
Buffkin et al.

(10) Patent No.: US 7,307,203 B2
(45) Date of Patent: Dec. 11, 2007

(54) STRING INSTRUMENT CHORD PLAYER

(76) Inventors: Mickey Buffkin, P.O. Box 71, Jefferson, AR (US) 72079; Roger Buffkin, 424 W. 4th St., Stuttgart, AR (US) 72160

( * ) Notice: Subject to any disclaimer, the term of this patent is extended or adjusted under 35 U.S.C. 154(b) by 130 days.

(21) Appl. No.: 11/235,518

(22) Filed: Sep. 26, 2005

(65) Prior Publication Data

US 2006/0075874 A1 Apr. 13, 2006

Related U.S. Application Data

(60) Provisional application No. 60/617,259, filed on Oct. 8, 2004.

(51) Int. Cl.
*G10D 1/12* (2006.01)

(52) U.S. Cl. ..... 84/286

(58) Field of Classification Search ..... 84/286, 84/287, 285, 288, 289
See application file for complete search history.

(56) References Cited

U.S. PATENT DOCUMENTS

| | | | | |
|---|---|---|---|---|
| 2,669,151 | A * | 2/1954 | Maccaferri | 84/317 |
| 4,228,718 | A * | 10/1980 | Smith | 84/317 |
| 4,331,059 | A * | 5/1982 | Marabotto | 84/317 |
| 5,223,659 | A | 6/1993 | Shiraki et al. | |
| 5,540,133 | A | 7/1996 | Draper et al. | |
| 6,034,310 | A | 3/2000 | Kolano | |

* cited by examiner

*Primary Examiner*—Kimberly Lockett
(74) *Attorney, Agent, or Firm*—Raymond M. Galasso; Galasso & Associates, LP

(57) ABSTRACT

A string chord player for a string instrument such as a guitar designed to be surroundably mounted onto the neck of the guitar. The string chord player includes an upper housing configured to mate with a lower housing forming an opening for receipt therein of a neck of a guitar. Integrally mounted to the upper housing is a plurality of buttons with outwardly facing chord designations. Opposite the chord designations is a string engagement portion of the button that when the button is placed into a second position will temporarily engage the adjacent longitudinally mounted strings on the neck of the guitar.

18 Claims, 3 Drawing Sheets

STRING INSTRUMENT CHORD PLAYER

PRIORITY UNDER 35 U.S.C. §119(e) & 37 C.F.R. §1.78

This nonprovisional application claims priority based upon the following prior U.S. provisional patent application entitled: Key mate, Application No.: 60/617,259, filed Oct. 8, 2004, in the names of Mikey Buffkin and Roger Buffkin, which is hereby incorporated by reference for all purposes.

FIELD OF THE INVENTION

The present invention relates to a device for playing a string instrument, and more specifically but not by way of limitation, a string chord player that is designed to surroundably mount the neck of a string instrument such as but not limited to a guitar. The string chord player is designed to facilitate the playing of a musical chord by pressing a single button. The button has displayed thereon a chord designation upon which engagement therewith by an individual will enable the user to play the string instrument and produce the desired sounds with limited or no musical training and without the need for significant hand dexterity.

BACKGROUND

Playing musical instruments can be enjoyed as a hobby or professionally. The playing of string instruments is one of the many types of instruments that are used by individuals. String instruments such as guitars, banjos and the like use a multiplicity of strings usually comprised of nylon or steel to produce a chord, or sound. The strings are typically mounted longitudinally superposed to a neck of a string instrument. The individual playing the string instrument will temporarily engage one or more strings by pressing the string against a fret transversely mounted on the neck at a desired point thus changing the vibrational length of the string resulting in a desired sound.

In order to produce desired sounds, the manual dexterity requirement for playing a string instrument is high. Positioning several figures at the required location to produce a chord takes a high degree of flexibility. Individuals who have difficulty manipulating their hands into the appropriate position whether due to age or medical condition can experience problems producing the chords desired.

Another problem arises during the learning phase with individuals who have little musical training and wish to engage in the activity of playing a string instrument. Many individuals lack the time or patience to practice at the level required to play a string instrument proficiently. The normal required amount of practice required to learn to play a string instrument can be very discouraging to a beginner. For those individuals, a device that would facilitate easier playing of the string instrument would enhance its enjoyment and provide encouragement during the learning phase.

Accordingly there is a need for a device that can be surroundably mounted to the neck of a string instrument that could facilitate easier playing of the instrument by reducing the degree of manual dexterity required as well as reducing the amount of musical training required to play the instrument.

SUMMARY OF THE INVENTION

It is an object of the present invention to provide a string chord player that can be releasably secured to the neck of a string instrument providing easier use of the string instrument by reducing the dexterity required to play as well as reducing the level of musical training normally necessary for playing a string instrument.

It is another object of the present invention to provide a string chord player that will provide a plurality of button with chords displayed thereon for the user to choose from to produce desired sounds.

Yet another object of the present invention is to provide a string chord player, that when surroundably mounted to the neck of a string instrument will not bind the strings and produce excessive string wear.

It is a further object of the present invention to provide a string chord player that is easy to use, lightweight, and durable.

To the accomplishment of the above and related objects the present invention may be embodied in the form illustrated in the accompanying drawings. Attention is called to the fact that the drawings are illustrative only. Variations are contemplated as being part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
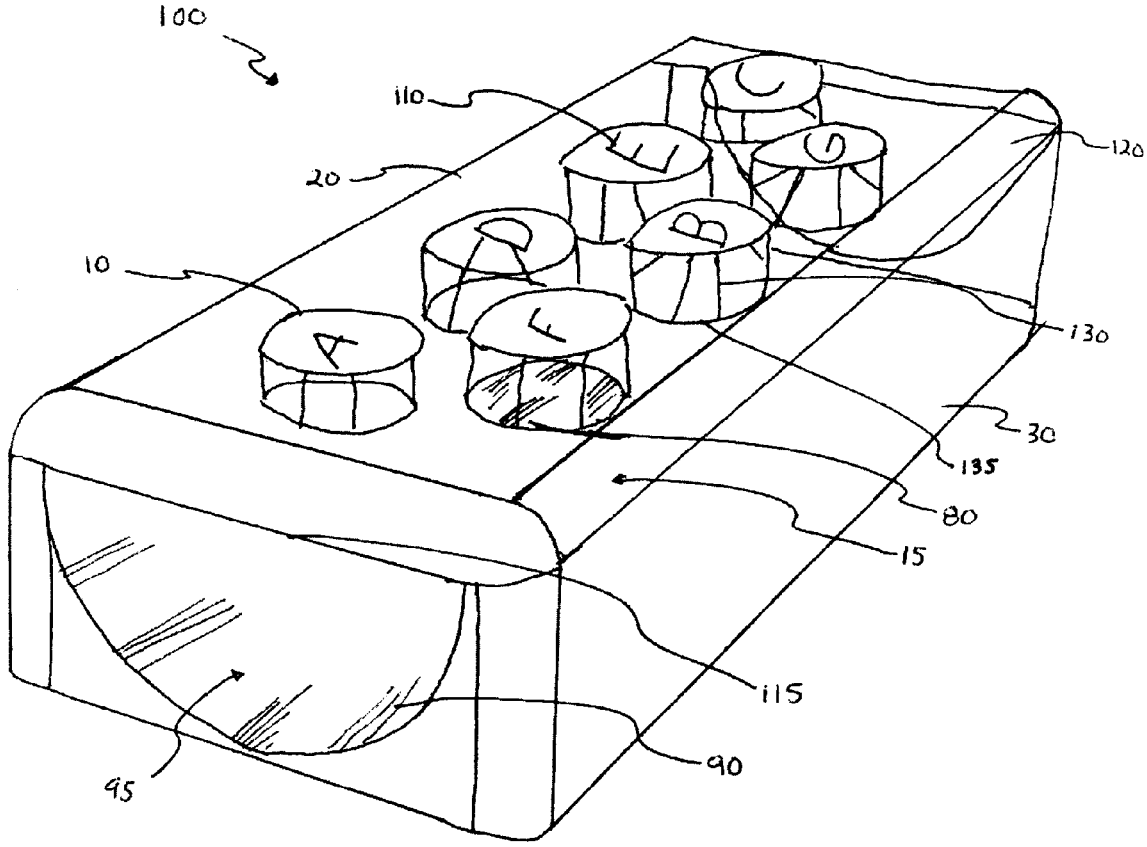
FIG. 1 illustrates a perspective view of an embodiment of the present invention.
Figure 2:
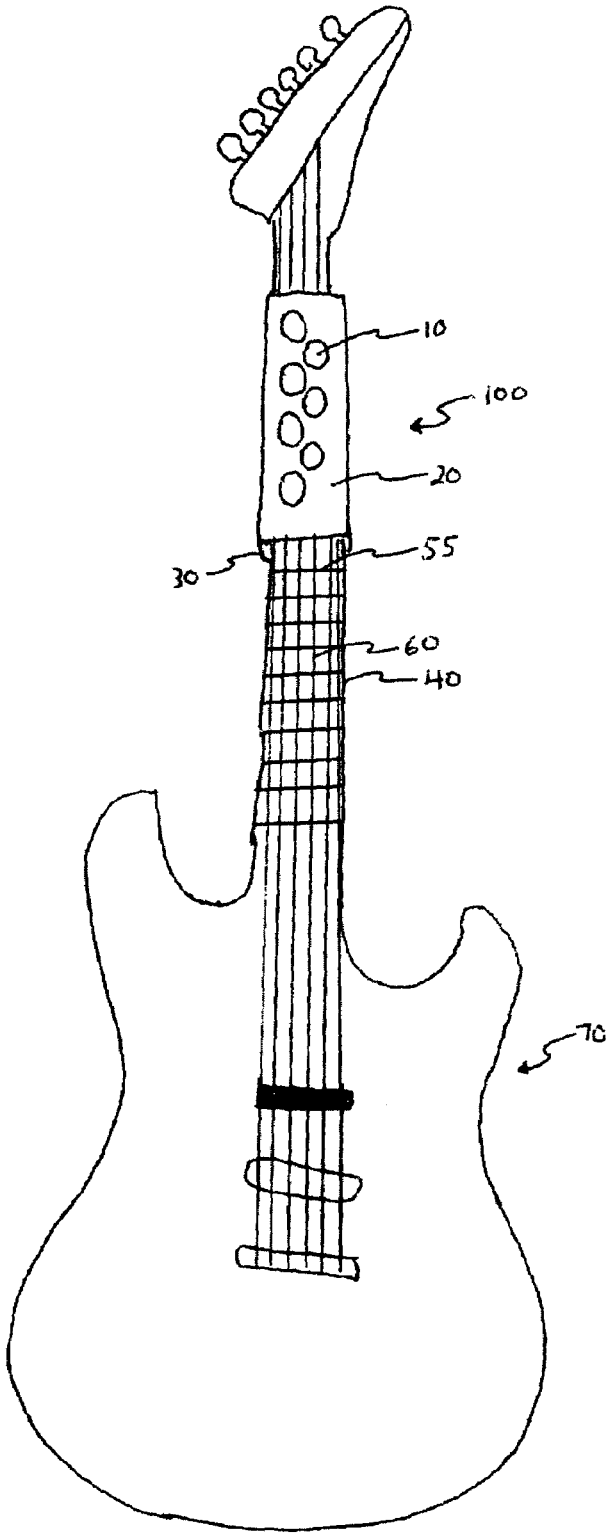
FIG. 2 illustrates a perspective view of an embodiment of the present invention surroundably mounted to the neck of a guitar.
Figure 3:
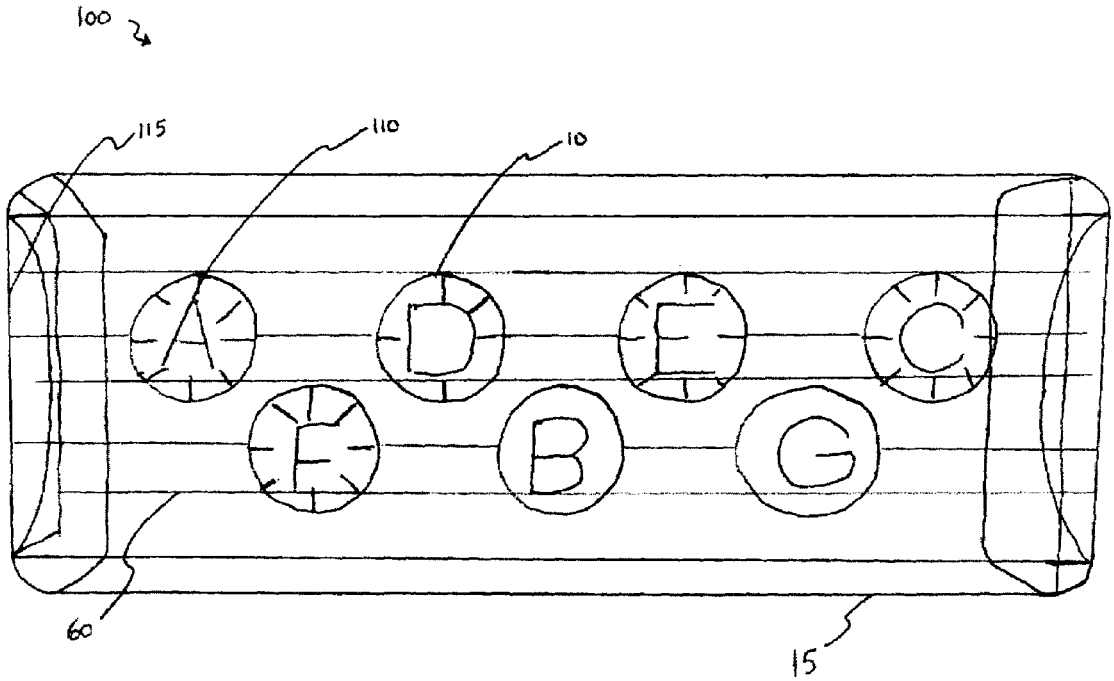
FIG. 3 illustrates a top perspective view of an embodiment of the present invention.

Referring now to the drawings, wherein various elements depicted are not necessarily drawn to scale, and in particular FIGS. 1 and 2 there is illustrated a string chord player 100 constructed according to the principles of the present invention.

The string chord player 100 comprises a housing 15 generally rectangular in shape. The housing 15 is surroundably mounted parallel to the neck 40 of the guitar 70. The housing 15 includes a lower housing 30 and an upper housing 20. The upper housing 20 is configured in a substantially planar manner and is generally rectangular in shape being of sufficient size to mate with the lower housing 30. The upper housing 20 and the lower housing 30 form an opening 95 for receipt therein of the neck 40 of the guitar 70. The upper housing 20 includes a peripheral edge 120 that is rounded to provide comfort for the users hand while engaged with the string chord player 100. The upper housing 20 is releasably secured to the lower housing 30 by conventional mechanical methods such as but not limited to snaps. Those skilled in the art will recognize that numerous mechanical methods could be utilized to secure the upper housing 20 to the lower housing 30. More specifically but not by way of limitation the upper housing 20 could be fastened to the lower housing 30 by a conventional mechanical hinge. The lower housing 30 includes an inner surface 90 that is generally arcuate in shape. The inner surface 90 of the lower housing 30 lies adjacent to the neck 40 opposite the strings 60. Although the inner surface 90 is shown in the illustrated embodiment as being arcuate in shape, it is contemplated within the scope of the present invention that the inner surface 90 could be shaped to conform to the shape of the neck 40 of a variety of string instruments. It is contemplated within the scope of the present invention that the size of the housing 15 could vary dependent upon the guitar 70, good results have been shown to be achieved with a housing 15 that is three inches in height by three inches in width and six inches in length.

The housing 15 is manufactured from conventional materials such as plastic. Those skilled in the art will recognize that many different materials could be used in place of and/or in conjunction with plastic to manufacture the housing. More specifically but not by way of limitation the housing 15 could be manufactured with metal or wood. It is also contemplated to be within the scope of the present invention that the upper housing 20 could be translucent to provide viewing of the strings 60 by the user. Further, it is contemplated within the scope of the present invention that the housing 15 could be manufactured in a variety of colors to coordinate with a particular guitar 70.

Referring now to FIG. 2, the housing 15 is shown mounted to the neck 40 of a guitar 70. Transversely mounted on the neck 40 are a plurality of frets 55. Longitudinally mounted to the neck 40 is a set of strings 60. The upper housing 20 when engaged with the lower housing 30 transverses the neck 40 superposed to the strings 60. The forward end 115 of the upper housing 20 is manufactured such that it provides the necessary lateral clearance to avoid touching the strings 60 when the string chord player 100 is surroundably mounted on the neck 40. Located in the upper housing 20 are a plurality of buttons 10. The buttons 10 are generally cylindrical in shape and of sufficient length to be journaled through the apertures 135 integrally manufactured into the upper housing 20. The buttons 10 each have a chord designation 110 displayed thereon. The buttons 10 are mounted to the upper housing 20 biased in a first position by coil springs 130. The springs 130 bias the button 10 in a first position to avoid contacting the adjacent strings 60 underneath when the string chord player 100 is surroundably mounted to the neck 40 of the guitar 70. Those skilled in the art will recognize that numerous different mounting methods of the buttons 10 could be used in place of and/or in conjunction with coil springs.

Referring in particular to FIG. 1, the buttons 10 downwardly extend through the apertures 135 in the upper housing 20. Opposite the chord designation 110 is a string engagement portion 80 of the button 10. The string engagement portion 80 is manufactured to engage with the specified adjacent strings 60 at the fret 55 to produce the chord designated by the chord designation 110. When the string chord player 100 is assembled and surroundably mounted to the neck 40, each button 10 is in position to provide a particular chord or sound that is displayed by the chord designation 110 of the button 10. The string engagement portion 80 of the button 10 engages with the appropriate adjacent strings 60 superposed along a fret 55 when the user downwardly extends the button 10 to its second position. Once engaged with the string 60, the string engagement portion 80 of the button 10 changes the vibrational length of the string 60 allowing the guitar 70 to produce the desired sound when the strings 60 are strummed.

As illustrated in FIG. 2, there are seven buttons 10 mounted to the upper housing 20 of the string chord player 100. These buttons 10 are designed to produce chords A-F. It is contemplated within the scope of the present invention that the string chord player 100 could be manufactured with a numerous different amount of buttons 10 to produce different chords. The buttons 10 are manufactured from conventional materials such as but not limited to plastic. Those skilled in the art will recognize that numerous material in place of and/or in conjunction with plastic to manufacture the buttons 10.

It is contemplated within the scope of the present invention that the string chord player 100 could be integrally manufactured into the neck 40 of the guitar. Further, it is contemplated that the string chord player 100 could be manufactured to integrate with a keyboard instrument such as but not limited to a piano.

Referring in particular to the drawings submitted herewith, a description of the operation of the string chord player 100 is as follows. The user will place the lower housing 30 adjacently underneath the neck 40 of the guitar 70 in the desired position. The user then releasably secures the upper housing 20 to the lower housing 30 locking the string chord player 100 in place parallel to the neck 40. The forward end 115 of the upper housing 20 lies adjacently above but not touching the strings. The user will then apply a downward force to one of the biased buttons 10 to release it from the first position and move the button 10 to the second position. The string engagement portion 80 of the button 10 temporarily engages with the adjacent strings mounted underneath during the second position. This causes the strings 60 adjacent to the frets 55 to engage with the fret 55 and change the vibrational length of the string 60. The user will then simultaneously strum the strings with the button 10 in the second position to produce the chord designated by the chord designation 110 on the button 10. The user will then release the button 10 to return it to its first position and then repeat the process to produce a different chord using one of the plurality of buttons 10. Upon completion of playing the guitar 70 the string chord player 100 can be removed from the neck 40.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A string instrument chord player for a string instrument having a neck comprising:

an upper housing, said upper housing being configured in a substantially planar manner and generally rectangular in shape;

a lower housing, said lower housing being releasably secured to said upper housing for surroundably mounting said neck of a string instrument; and wherein said lower housing has an inner surface, said inner surface being generally arcuate in shape; and an opening, said opening being formed by said upper housing and said lower housing for receipt therein of said neck of said string instrument.

2. The string instrument chord player as recited in claim 1, and further including at least one aperture in said upper housing.

3. The string instrument chord player as recited in claim 2, and further including at least one button journaled through said aperture, said button having a first position and a second position.

4. The string instrument chord player as recited in claim 3, wherein said button further includes a musical chord designation.

5. The string instrument chord player as recited in claim 4, wherein said button further includes a string engagement portion, said string engagement portion for contacting strings longitudinally mounted along said neck of said string instrument.

6. The string instrument chord player as recited in claim 3, wherein said button is mounted in said aperture with coil springs.

7. The string instrument chord player as recited in claim 6, wherein said upper housing and said lower housing are manufactured from plastic.

8. A string instrument chord player for a string instrument having a neck with longitudinally mounted strings and a plurality of transversely mounted frets comprising:

an upper housing, said upper housing being configured in a substantially planar manner and generally rectangular in shape, said upper housing having a peripheral edge;

a lower housing, said lower housing being releasably secured to said upper housing for surroundably mounting said neck of a string instrument, said lower housing having an inner surface, said inner surface being generally arcuate in shape;

an opening, said opening being formed by said upper housing and said lower housing for receipt therein of said neck of said string instrument;

at least one aperture, said aperture being formed in said upper housing, said upper housing being adjacent to said strings;

at least one button, said button journaled through said aperture; and wherein said button further includes a string engagement portion capable of engaging the specified adjacent string.

9. The string chord player as recited in claim 8, wherein said button further comprises a string engagement portion, said string engagement portion being adjacently superposed to said string on said neck of said string instrument.

10. The string chord player as recited in claim 9, wherein said button has a first position and a second position, said button in said first position is biased away from said string of said string instrument.

11. The string chord player as recited in claim 10, wherein said button is mounted in said aperture with coil springs.

12. The string chord player as recited in claim 11, wherein said string engagement portion of said button is temporarily engaged with said strings of said string instrument upon said button being biased into said second position.

13. The string chord player as recited in claim 12, wherein said button has designated thereon a musical chord.

14. The string chord player as recited in claim 13, wherein said peripheral edge of said upper housing is generally rounded in shape to provide comfort for a user's hand.

15. A string instrument chord player for a string instrument having a neck with longitudinally mounted strings and a plurality of transversely mounted frets comprising:

an upper housing, said upper housing being configured in a substantially planar manner and generally rectangular in shape, said upper housing being positioned adjacent to said string of said string instrument, said upper housing having a peripheral edge that is generally rounded in shape;

a lower housing, said lower housing being generally rectangular in shape said lower housing being releasably secured to said upper housing such that said lower housing and said upper housing for surroundably mounting said neck of a string instrument, said lower housing having an inner surface, said inner surface being generally arcuate in shape, said inner surface being adjacent to said neck opposite said strings when said string instrument chord player is surroundably mounted to said neck;

an opening, said opening being formed by said upper housing and said lower housing for receipt therein of said neck of said string instrument;

seven apertures, said apertures being formed in said upper housing; and seven buttons, said buttons being journaled through said apertures, said buttons having a first position and a second position; and wherein said buttons are biased into said first position with coil springs and wherein said buttons are manually manipulated into said second position.

16. The string chord player as recited in claim 15, wherein said buttons further include a string engagement portion for temporarily engaging with said adjacent strings while said button is in said second position.

17. The string chord player as recited in claim 16, wherein said buttons have chord designations thereon.

18. The string chord player as recited in claim 17, wherein said lower housing sand said upper housing measure approximately 3 inches H×3 inches W×6 inches L.

* * * * *